US011131516B2

(12) United States Patent
Lam et al.

(10) Patent No.: US 11,131,516 B2
(45) Date of Patent: Sep. 28, 2021

(54) SHELL CASING RECEIVER

(71) Applicants: Chong Lam, Puyallup, WA (US); Michael Weiss, San Jose, CA (US)

(72) Inventors: Chong Lam, Puyallup, WA (US); Michael Weiss, San Jose, CA (US)

( * ) Notice: Subject to any disclaimer, the term of this patent is extended or adjusted under 35 U.S.C. 154(b) by 0 days.

(21) Appl. No.: 16/747,925

(22) Filed: Jan. 21, 2020

(65) Prior Publication Data

US 2020/0232736 A1 Jul. 23, 2020

Related U.S. Application Data

(60) Provisional application No. 62/794,925, filed on Jan. 21, 2019.

(51) Int. Cl.
*F41A 9/60* (2006.01)

(52) U.S. Cl.
CPC ..... *F41A 9/60* (2013.01)

(58) Field of Classification Search
CPC ..... F41A 9/60; F41C 33/006–008
See application file for complete search history.

(56) References Cited

U.S. PATENT DOCUMENTS

| | | | | |
|---|---|---|---|---|
| D361,506 | S * | 8/1995 | Rumpel | D8/395 |
| D564,347 | S * | 3/2008 | Limber | D8/395 |
| 7,562,484 | B2 * | 7/2009 | Kim | F41G 11/003 24/282 |
| 8,650,794 | B2 * | 2/2014 | Swan | F41C 33/007 42/90 |
| 8,839,546 | B2 * | 9/2014 | Taylor | F41C 33/007 42/85 |

OTHER PUBLICATIONS

"Deck Clips | Adams Maufacturing", https://www.adamsmfg.com/products/christmas-hardware-accessories/light-clips/deck-clips (Year: 2018).*

* cited by examiner

*Primary Examiner* — Joshua T Semick
(74) *Attorney, Agent, or Firm* — Ellenoff Grossman & Schole LLP; James M. Smedley; Alex Korona

(57) ABSTRACT

The present invention generally relates to a firearm shell casing receiver. The invention generally comprises of a horseshoe shaped member with widened ends and an arm member that serves as a clip to allow for the attachment of a receiver vesicle. To utilize the current invention, the shell casing receiver securely grips onto a firearm's platform whereas the clip portion holds a receiver vesicle to capture any spent ammunition.

20 Claims, 5 Drawing Sheets

SHELL CASING RECEIVER

RELATED APPLICATIONS

This application claims the benefit of U.S. Provisional Patent Application No. 62/794,925 filed Jan. 21, 2019, which is hereby incorporated by reference in its entirety.

FIELD OF THE INVENTION

This invention relates generally to a universal receiving apparatus for collecting/depositing spent ammunition shells/casings making it easier to clean up your brass.

BACKGROUND

There is an economic benefit to reloading spent shell casings from shot bullets. By individually assembling the components of a firearm cartridge (including the case/hull, primer, powder, and bullet) within an already used shell, the regular shooter financially benefits from such resourcefulness.

Another benefit to reloading spent shell casings is the ability to customize the performance of ammunition. By building cartridges that precisely fit a firearm's chamber with bullets seated as close to the lands as needed, a shooter can induce maximum accuracy performance.

The current state of shell collectors comprises of three types of brass collectors. The first type is a bulkiest option which operates similar to a sweeper cleaner. The user rolls the brass collector over the shells that are then captured by a rolling bristle. Due to the size and cost of such apparatus, such collector is inefficient for the solo firearm user. The second type of collector is a compact version of the sweeper-style apparatus. Nonetheless, this version is still too bulky for the solo firearm user. The third type is the most compact collector is a bag or some other collection means that reversible attaches to a firearm. The drawbacks of such apparatus is that it has multiple attachment points, requiring both hands for assembly. Further, such device adds weight to the firearm and wears on the firearm's surface, it is also difficult to show the range master your chamber is clear during a cease fire.

Accordingly, there is a need in the arms for a lightweight and portable bag collector that is easily adaptable to any firearm without adding excessive weight. This and other features are described in the current application.

SUMMARY OF THE INVENTION

Figure 1:
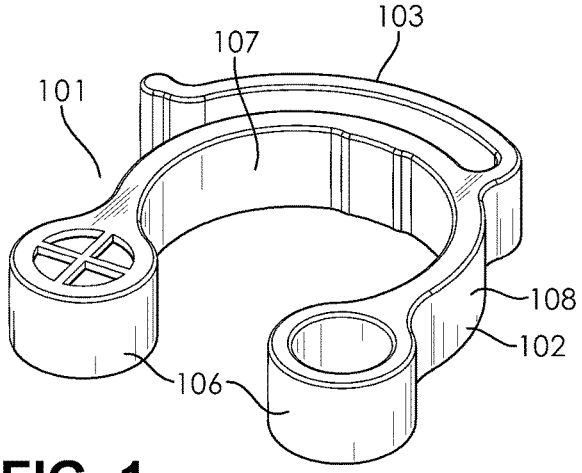
FIG. 1 is a front perspective view of the preferred embodiment of the current invention.
Figure 2:
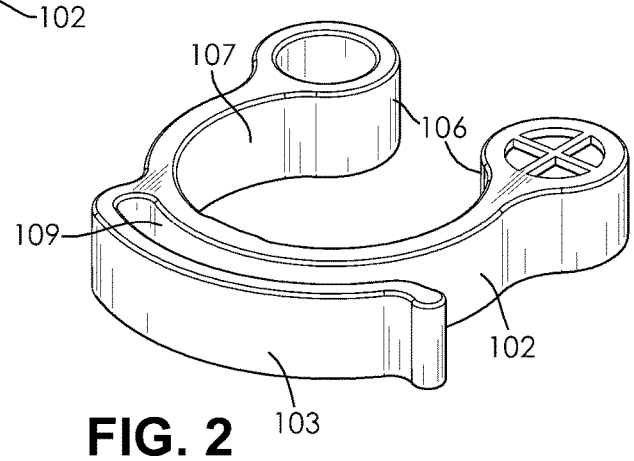
FIG. 2 is another front perspective view of the preferred embodiment of the current invention.
Figure 3:
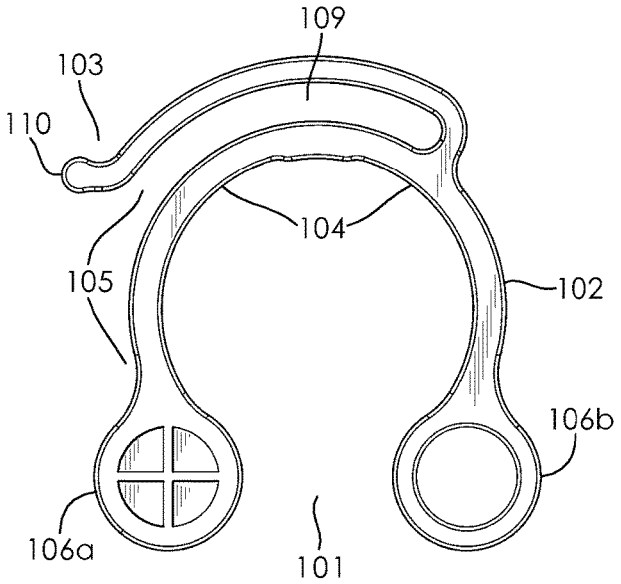
FIG. 3 is another front perspective view of the preferred embodiment of the current invention.
Figure 4:
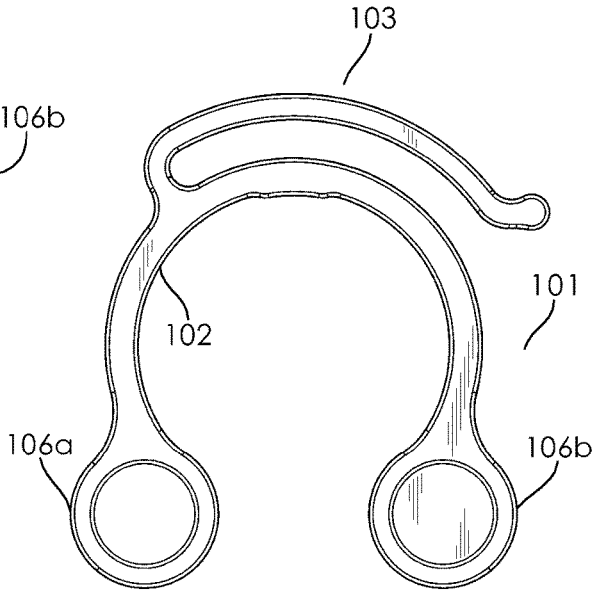
FIG. 4 is a rear perspective view of the preferred embodiment of the current invention.
Figure 5:
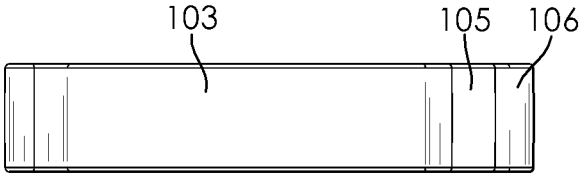
FIG. 5 is a top perspective view of the preferred embodiment of the current invention.
Figure 6:
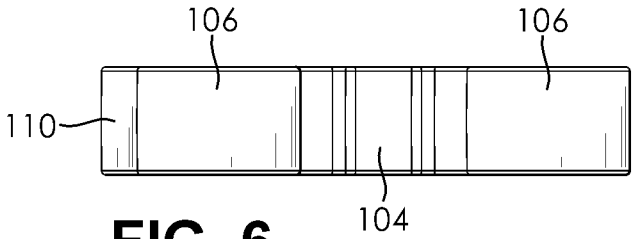
FIG. 6 is a bottom perspective view of the preferred embodiment of the current invention.
Figure 7:
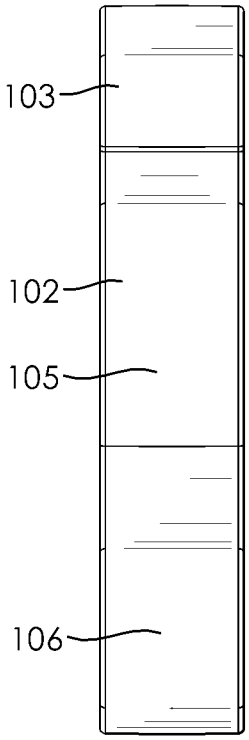
FIG. 7 is a side perspective view of the preferred embodiment of the current invention.
Figure 8:
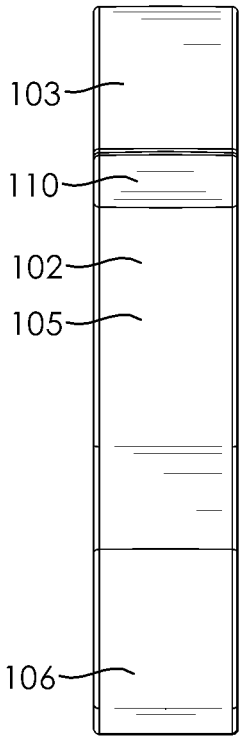
FIG. 8 is the other side perspective view of the preferred embodiment of the current invention.
Figure 9:
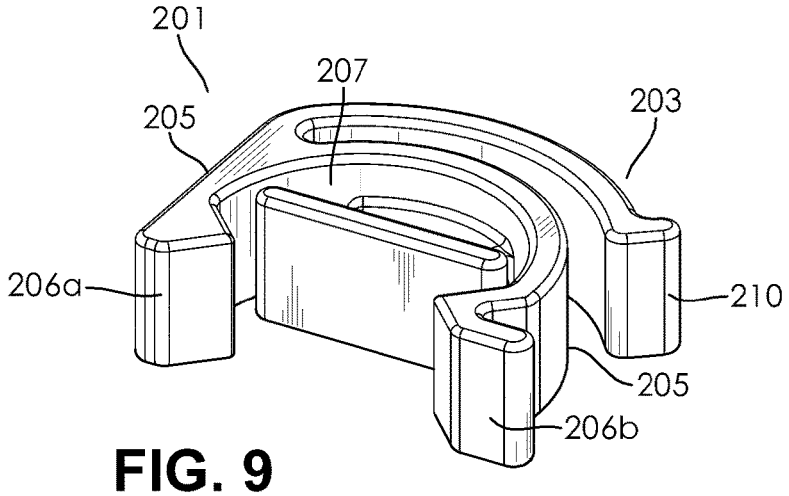
FIG. 9 is a front perspective view of an alternate embodiment of the current invention.
Figure 10:
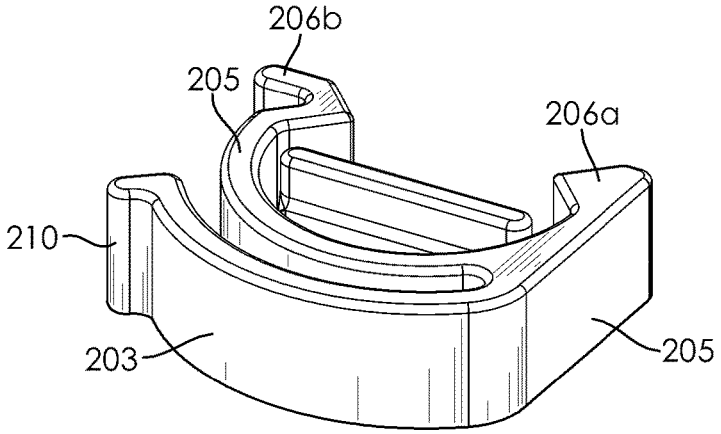
FIG. 10 is another front perspective view of an alternate embodiment of the current invention.
Figure 11:
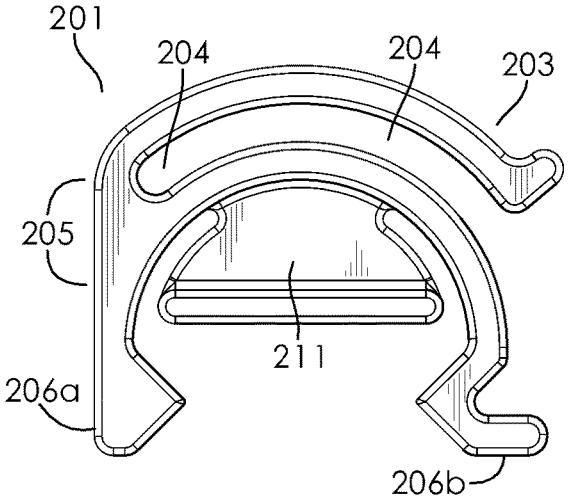
FIG. 11 is another front perspective view of an alternate embodiment of the current invention.
Figure 12:
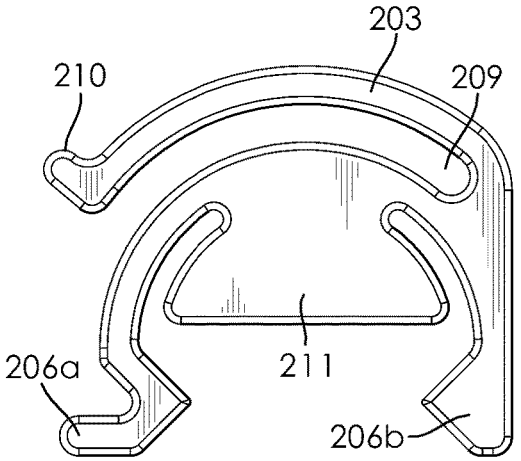
FIG. 12 is a rear perspective view of an alternate embodiment of the current invention.
Figure 13:
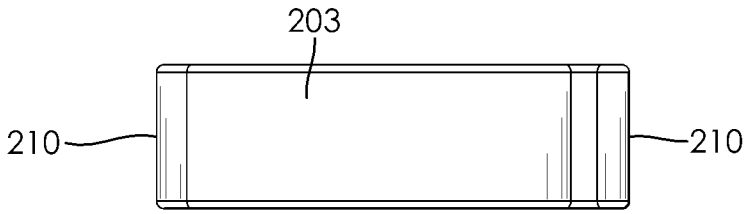
FIG. 13 is a top perspective view of an alternate embodiment of the current invention.
Figure 14:
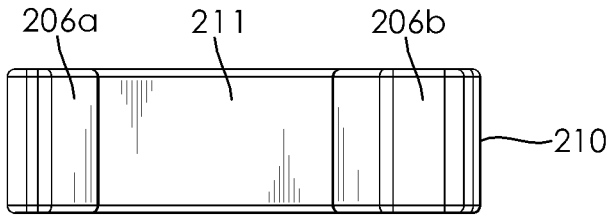
FIG. 14 is a bottom perspective view of an alternate embodiment of the current invention.
Figure 15:
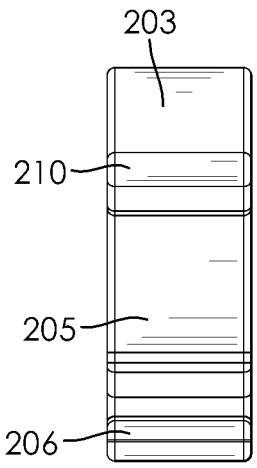
FIG. 15 is a side perspective view of an alternate embodiment of the current invention.
Figure 16:
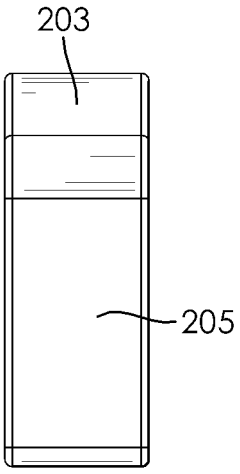
FIG. 16 is the other side perspective view of an alternate embodiment of the current invention.

Embodiments of the invention as described herein relate to a versatile shell casing receiver for receiving and holding spent or fired shell casings. According to embodiments of the current invention, a shell casing receiver comprising of a horseshoe member and an arm member wherein said arm member extends from a crown segment of said horseshoe member so that there is an inlet between said horseshoe member and said arm member.

According to embodiments of the current invention, the arm member extends over the crown of the horseshoe member. Specifically, the arm member substantially follows the curvature of the horseshoe member.

According to embodiments of the current invention, the terminal ends of the horseshoe member are bulb shape. In some embodiments, one or more bulbous ends are hollow. In alternate embodiments, one or more bulbous ends are solid. In even further embodiments, one bulbous end is hollow while the other bulbous end is solid.

According to alternate embodiments of the current invention, the terminal ends of the horse member are triangular or substantially triangular. Specifically, the apex of each triangular (or substantially triangular) end are faced towards each other. In some embodiments, one or both of the triangular ends are indented at a base end.

According to alternate embodiments of the current invention, the shell casing receiver is also comprised of a mounting member. The mounting member extends from the crown segment of horseshoe member towards the center of the arch. In some embodiments, the bottom end of the mounting member is flat. In some embodiments, the mounting member extends from a rear end of the inner edge of the horseshoe member so that the rear side of the she casing receiver is planar.

According to embodiments of the current invention, the terminal end of an arm member is configured with a hook extension.

A shell casing collection kit is also claimed. The shell casing collection kit comprises a (i) shell casing receiver with a horseshoe member and an arm member and (ii) a sleeve. The shell casing receiver includes a horseshoe member and an arm member. The arm member can either be projected from the crown of the horseshoe member or the hauch of the horseshoe member. The extension of the arm member from the horseshoe member creates an inlet between the two members. The sleeve is adapted to be received within the inlet.

Detailed Specification

In the preferred embodiment, a universal apparatus that is adapted to receive ejected shell casings from a firearm comprising of two members is disclosed. The shell casing receiver is a horseshoe-shaped member with an extending arm member. In one embodiment, the arm member protrudes from the crown portion of the horseshoe member and generally follows the curvature of the crown portion of the horseshoe member. Alternate embodiments include an arm member that is projected from other portions of the horseshoe member. The relative position of arm member from the horseshoe member creates a gap or inlet between the members. The horseshoe member provides sufficient flexibility to hug a platform of a firearm, thereby adapting to any position on any firearm. The arm member allows the user to employ a collection device, such a bag or the user's head-wear to capture/deposit the spent shells. The shell casing receiver ends with terminal ends that serve as fasteners.

In embodiments of the current invention, the horseshoe member is generally a continuous piece with indistinct portions. A lateral sides of the horseshoe member are referred to as the hauch(es). On one end, the hauch extends into a terminal end of the horseshoe member; on the other end, the haunch extends into the crown of the horseshoe member. The highest point of the crown is the apex.

In the preferred embodiment, the arm member extends out from the area where the hauch becomes the crown portion of the horseshoe member and unfurls over the crown so there is an inlet between the two members. In alternate embodiments, the arm member extends from the hauch. Specifically, in the alternate embodiments, there are two projections from the inner edge of the hauch—one projection protracts into the crown of the horseshoe member while the other projection protracts into the arm member.

According to embodiments of the current invention, a catching device is affixed to a firearm by means of the arm member. The curvature of the arm member facilitates the threading of a catching device onto the shell casing receiver. Meanwhile the terminal end of the arm member functions to secure the catching device in place. Embodiments of the current invention include one of many ends on the arm member. In the preferred embodiment, the terminal end of the arm member interrupts the curvature and projects outwards. In other embodiments, the arm member projects at an angle less than ninety (90) degrees.

Furthermore, embodiments of the current invention include arm members that that extend in either the right direction or the left direction. This allows the user to mount a catching device on either side of the firearm rendering the current invention suitable for both right-handedness and left-handedness.

The terminal ends of the horseshoe member are designed as fasteners to bolster the current invention's ability to secure latch onto a receiving party. In general, the ends comprise of projecting elements that reinforce the clamping ability of the current invention. In one embodiment, the terminal ends are bulbous in shape. The bulges reduce the distance between each end thereby functioning as a barrier to restrict the current invention's ability to snap off the firearm. Alternate embodiments include ends with sharp projections that are triangular in configuration.

Once the horseshoe member is secured, the arm member functions as a clip to secure a catching device. The inlet created between the arm member and the horseshoe member is able to receive any pliable material that functions as net for catching the ejected shells. Further, the narrow and curved nature of the inlet prevents the pliable material from sliding out.

Embodiments of the current invention function to snap onto any type of receptive part, including but not limited to the scope, red dot site, and the rails. Notably, the current invention is is adaptable to any and all rail system types such as the dovetail rail, the Picatinny rail, M-lock system, and KeyMod system According to the preferred embodiment of the current invention, the shell casing receiver may be comprised of plastic material. Alternative embodiments may comprise of metal and/or a hybrid material comprising of metal and plastic.

Turning to FIGS. 1-8 show a preferred embodiment of the current invention. In this embodiment, the shell casing receiver (101) comprises of an arm member that extends from the junction of the crown (104) and the hauch (105) of the horseshoe member (102) on the outer edge (108) of the shell casing receiver (101). Specifically, the arm member (103) extends from the outer edge (108) of the horseshoe member. As the arm member (103) curves over the horseshoe member's crown (104), an inlet (109) between the member is formed. A shell casing receiver can slide through the members while the arm member terminal end (110) hooks onto the shell casing receiver to prevent it from sliding out. In the current embodiment, the terminal ends (106*a*, 106*b*) are configured as bulbous ends that fasten or lock the shell casing receiver into the straddling position. In this embodiment, the inner edge (107) is uninterrupted.

Turning to FIGS. 9-16 are an alternate embodiment of the current invention (201). Pursuant to this embodiment, the inner edge (207) and the outer edge (208) of a hauch (205) on one side of the horseshoe member (202) are distinguishable. Specifically, the inner edge of the hauch is curved and forms the body of the horseshoe member. However, the outer edge is relatively linear and extends into the arm member (203), forming an inlet (209) between the crown (204) and the arm member (203). Furthermore, the alternate embodiment further comprises a mounting member (211) that extends from the crown (204) and ends in a flat surface. The terminal ends (206*a* and 206*b*) of the alternate embodiment are configured with two pointed ends. Specifically, the terminal ends are comprised of generally triangular shapes whose apexes face one another. In the illustrated embodiment, at least one terminal end is indented at a side opposite the apex. In this embodiment the arm member terminal end (210) flips up at an angle.

Figure 17:
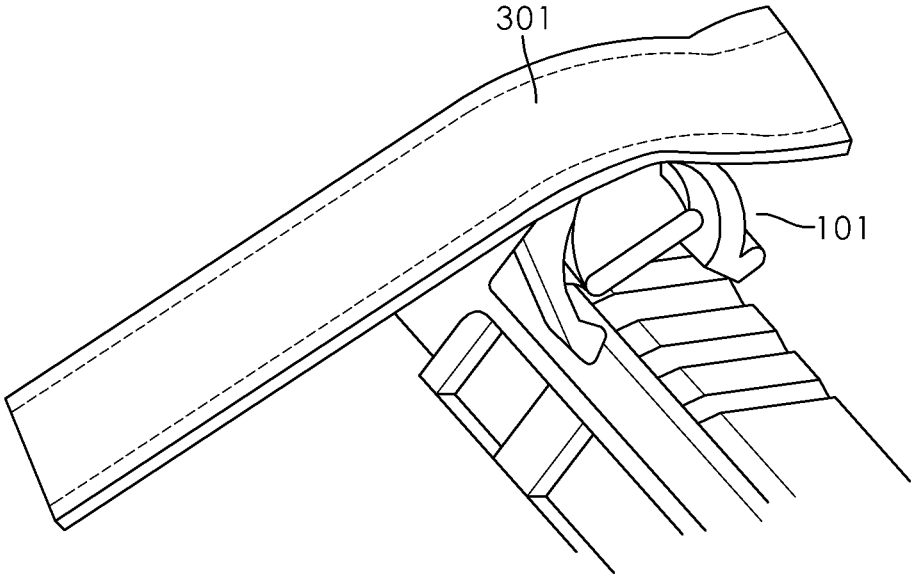
FIG. 17 is a perspective view of a kit comprising of the preferred embodiment of the current invention.

Turning to FIG. 17 is an exemplary embodiment of a kit comprising of the preferred embodiment of the shell casing receiver (101) and a sleeve (301). According to exemplary embodiment, a shooter affixes the shell casing receiver (301) upon a part of the firearm onto a firearm rail. Once the shell casing receiver is secure, the shooter threads a catching device onto the shell casing receiver. When the shooter fires, the discharged casings are captured in the catching vesicle. The catching device can take many forms. As an example, a baseball hat or a cap may be used as catching devices.

According to embodiments of the shell casing collection kit, the sleeve is a tube. One side of the tube is a clip side that is threaded through and latches onto the shell casing receiver. The opposite side is the stiffener side that is configured to hold the collected shell casings. In detail, the sleeve is long panel, where at least one end of the panel is folded over and affixed at the side seams to yield a pocket on the clip side. In some embodiments, the arm member if fully received within the pocket. In alternate embodiments, the pocket comprises of one or more slits through which the arm member project out of the pocket. The stiffener side hangs over the shell casing receiver and is also configured with a pocket to store the collected casing. In some embodiments, the pocket on the stiffener side is folded over so that the bottom portion is continuous while the side seams are fastened together by thread, glue, or any other adhesive material. In alternate embodiments, the pocket on the stiffener side is formed by fastening a separate piece.

According to an alternate embodiment of the sleeve component, each sleeve may be reversible closed with a sealing means such as zippers and/or buttons. Furthermore, the sleeve may be customizable to allow for customized images (e.g. via silk screen process, embroidery).

In the preferred embodiment, the sleeve is comprised of heavy weight fabrics such as upholstery fabric, canvas, and denim. However, alternate embodiments include lightweight materials such as nylon (in solid and mesh form).

It will be readily apparent that the shell casing receiver is easily and quickly snapped onto (and off) of a firearm yet still firmly and securely positions itself without the need for additional hardware or accessories. The shell casing receiver can be slightly modified to affix to any type of base or firearm component, and is of simple construction. This renders the current invention relatively inexpensive to manufacture.

The invention claimed is:

1. A shell casing receiver comprising of an open looped horseshoe member comprising of two side haunches and a centrally located crown segment and an arm member wherein said arm member extends from said crown segment of said horseshoe member so that there is an inlet between said horseshoe member and said arm member, wherein a distance within the inlet between the crown segment of said horseshoe member and the arm member is equidistant throughout the span of the inlet.

2. The shell casing receiver of claim 1, wherein each haunch extends into a bulbous end at each terminal end of said horseshoe member.

3. The shell casing receiver of claim 2, wherein at least one bulbous end is hollow.

4. The shell casing receiver of claim 2 wherein at least one bulbous end is solid.

5. The shell casing receiver of claim 2 wherein said bulbous ends extend downwards in a direction away from said crown segment.

6. The shell casing receiver of claim 2 wherein each bulbous end is distal relative to said haunch from which each bulbous end extends.

7. The shell casing receiver of claim 1, wherein at least one terminal end of said horseshoe member points inward towards the other terminal end of said horseshoe member.

8. The mounting member of claim 7 wherein a bottom end of said mounting member is flat.

9. The shell casing receiver of claim 1, wherein at least one terminal end of said horseshoe member is substantially triangular, wherein an apex of said triangular terminal end faces said other terminal end of said horseshoe member.

10. The shell casing receiver of claim 1, wherein said horseshoe member is configured with a mounting member that extends from an inner edge of said crown segment.

11. The shell casing receiver of claim 10 wherein said mounting member extends from a rear end of an inner edge of said horseshoe member.

12. A shell casing receiver of claim 1, wherein a terminal end of said arm member is configured with a hook extension.

13. A shell casing receiver comprising of an opened looped horseshoe member and an arm member wherein said arm member extends from a hauch of said horseshoe member wherein said horseshoe member comprises of an inner edge surface and an outer edge surface;

wherein the inner edge surface and outer edge surface at each side of said horseshoe member extend into a sealed bulbous end at each terminal end of said horseshoe member, wherein each bulbous end is substantially circular and wherein an external surface of each bulbous end is approximately coextensively derived from the inner edge surface and outer edge surface.

14. The shell casing receiver of claim 13 wherein said arm member extends over a crown portion of said horseshoe member.

15. The shell casing receiver of claim 14 wherein said arm member substantially mimics a curvature of a crown portion of said horseshoe member.

16. The shell casing receiver of claim 14 wherein said bulbous ends are configured below a point at which said horseshoe member extends into said bulbous ends.

17. The shell casing receiver of claim 14 wherein said bulbous ends are configured outside of said open looped area of said horseshoe member.

18. The shell casing receiver of claim 14 wherein each bulbous end is substantially circular.

19. A shell casing collection kit comprising:

a shell casing receiver comprising of a horseshoe member and an arm member wherein said arm member extends from a crown segment of said horseshoe member so that there is an inlet between said horseshoe member and said arm member;

wherein a distance within the inlet between the crown segment of said horseshoe member and the arm member is equidistant throughout the span of the inlet and a sleeve being adapted for threading within said inlet.

20. The shell casing collection kit of claim 19, wherein said sleeve is comprised of fabric.

* * * * *